United States Patent [19]

Kocib

[11] Patent Number: 5,062,168

[45] Date of Patent: Nov. 5, 1991

[54] COVER-UP FOR INFANTS

[76] Inventor: Vera M. Kocib, 1315 Piper Dr., Lake Havasu City, Ariz. 86403

[21] Appl. No.: 631,999

[22] Filed: Dec. 21, 1990

[51] Int. Cl.[5] ..... A47G 9/00

[52] U.S. Cl. ..... 5/413; 5/484; 2/69.5

[58] Field of Search ..... 5/482, 413, 494, 484; 2/69.5

[56] References Cited

U.S. PATENT DOCUMENTS

| | | | |
|---|---|---|---|
| 1,583,419 | 5/1926 | Perl | 5/413 |
| 1,678,125 | 7/1928 | Petrescu | 2/69.5 |
| 2,227,751 | 1/1941 | Idelman | 5/494 |
| 2,358,410 | 9/1944 | Matthesius | 5/413 |
| 2,538,420 | 1/1951 | Junghans | 5/413 |
| 3,034,132 | 5/1962 | Landsberger et al. | 2/69.5 |
| 4,064,577 | 12/1977 | Walters | 5/484 |
| 4,254,900 | 3/1981 | Wheeler | 227/158 |
| 4,897,885 | 2/1990 | Lunt | 2/69.5 |
| 4,979,250 | 12/1990 | Troncone et al. | 5/482 |

*Primary Examiner*—Alexander Grosz

[57] ABSTRACT

A wrap for young infants (FIG. 3) that keeps them warm while allowing free movement of their limbs and bodies. The main middle section of the wrap (10) has a shape of an elongated oblong. It can be constructed as a flat bag and filled with batting (22) or other filling. Two rectangular single thickness flaps (16) are sewn to the sides of the middle section (10). To cover the baby, the lower part of the middle section is folded over the infant's body, and the two flaps are folded across it and tied together to hold it in place. A detachable square pad from a waterproof and/or stain resistant material can be placed on the middle section of the cover-up in a position optimal for protecting it from leaking diapers and for keeping it dry and sanitary.

7 Claims, 2 Drawing Sheets

COVER-UP FOR INFANTS

BACKGROUND

1. Field of Invention

This invention relates to infant nursery articles, specifically to covers and blankets.

2. Prior Art

Heretofore the only wrap used to keep the new born baby warm during his sleeping periods was a flannel or flannelette blanket. It is customarily 30'×40' (about 76 cm×102 cm) large and is generally available under the name of "Receiving Blanket". The baby is usually placed on this blanket diagonally and covered first by the lower corner of the blanket (FIG. 1A) and then by the two side corners (FIG. 1B). At colder temperatures, an additional blanket is used for a further cover. The receiving blanket also serves in handling the young infant by adults (for instance during his/her feeding times). As the infant grows, the receiving blanket is discarded, and a normal warm blanket takes its place during the baby's sleeping periods (day or night).

Either of these articles can only work satisfactorily under one condition, which is that the baby would not move. However, as anybody who ever took care of an infant would confirm, the reality is quite to the contrary. From the earliest age, it is the nature of every healthy infant to move. She/he kicks, waves arms, and stretches and wriggles his/her body, often quite vigorously. These movements are not only signs of vitality, but are also necessary for the baby's health: it is a well known fact that many babies suffer from constipation if not able to move vigorously. It follows that in handling the baby during the wakeful periods, the receiving blanket unwounds easily, slips, and is often more bother than help. Similarly, during the infant's sleep time, the receiving blanket left loose enough to allow for movements necessary for her/his health, gets frequently unstuck. If, on the other hand, the baby is firmly tucked in the blanket in order to stay warm the baby's movements are forcefully restricted, and he/she becomes understandably uncomfortable.

The situation is not much improved when the infant is old enough not to need the receiving blanket, because the generally used baby blanket very rarely stays in place as the infant moves in her/his sleep. In colder climates, to prevent ailments resulting from exposure to the cold air (not only common cold but also more serious illnesses, like for example bladder infection, which may become recurring), the mother or whoever is taking care of the baby has to correct this situation several times during the night. This, again, is an experience which is very common, and also very commonly complained about.

These disadvantages of a square piece of cloth known as Receiving Blanket which:

a) does not fulfill its purpose of keeping the baby warm without restricting his/her movements and making him/her uncomfortable, sometimes even extremely so, and b) is often more a hindrance than help in handling the baby (and most female visitors love to handle a baby);

and also the disadvantages of a commonly sold baby blanket which:

a) would not stay in place and keep the baby warm without frequent checking, b) inconveniences the persons who take care of the baby by interrupted sleep and resulting tiredness, and c) can result in cold related illnesses if proper care is not taken, made those to whom I presented my invention as a gift quite enthusiastic

OBJECTS AND ADVANTAGES

My invention removes all of the above stated shortcomings of the prior art. The infant is kept securely warm and at the same time is free to move her/his legs or whole body as much as he/she wants or needs. Also, with the disadvantage of loose wrap taken care of, the baby can be handled and carried much easier. The special construction of the cover-up I invented is such that it can replace both the receiving blanket and the normal blanket for many months of the infant's life. My grandchild, who is year-and-half old, is still sleeping in the same wrap that I made and gave to my daughter to try it out. Further objects and advantages of the cover-up will become apparent from a consideration of the drawings and ensuing description of it.

DESCRIPTION OF DRAWINGS AND DRAWING FIGURES

In the drawings, closely related figures have the same number but different alphabetical suffixes.

Figure 1A:
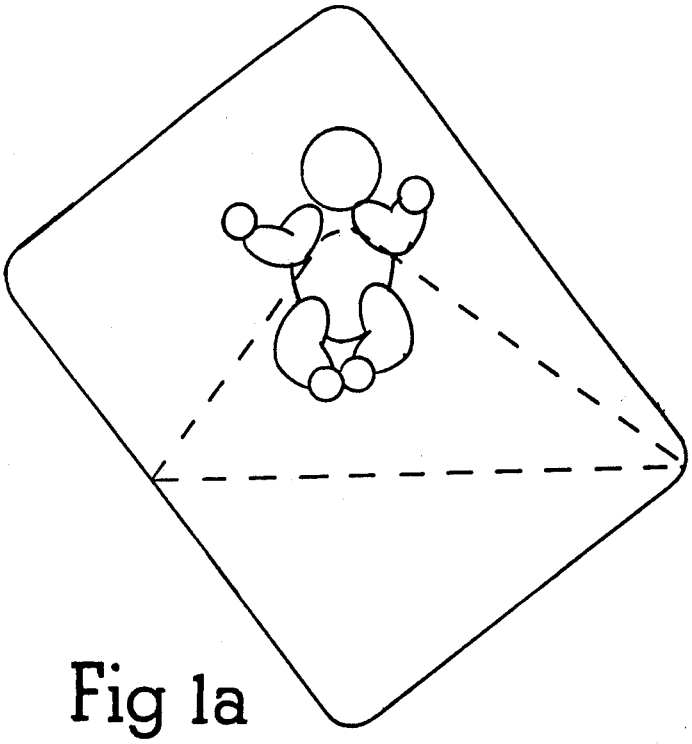
FIG. 1A is a schematic picture of prior art receiving blanket with the baby uncovered or partially covered.

10 top portion of the middle section of the cover-up
12 bottom portion of the middle section of the cover-up—upper half
14 bottom portion of the middle section of the cover-up—lower half
16 side flaps
18 detachable waterproof pad
hem/seam-binding channels for the ties
22 ties
24 stuffing cut out from batting
26 opening for insertion of batting

Figure 1B:
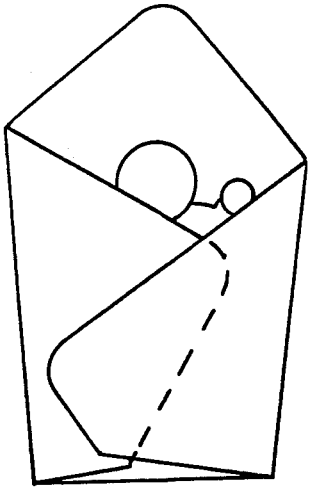
FIG. 1B is a schematic picture of receiving blanket covering the baby.

DESCRIPTION—FIG. 1 and 2

Figure 2A:
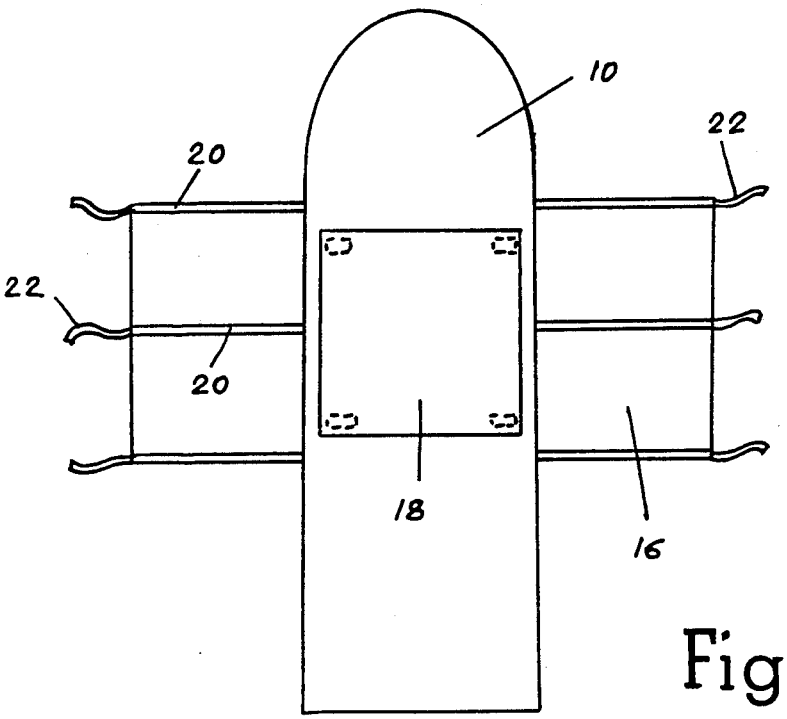
FIG. 2A is a picture of the top side of my invention in the opened position, with the detachable waterproof pad in place.
Figure 2B:
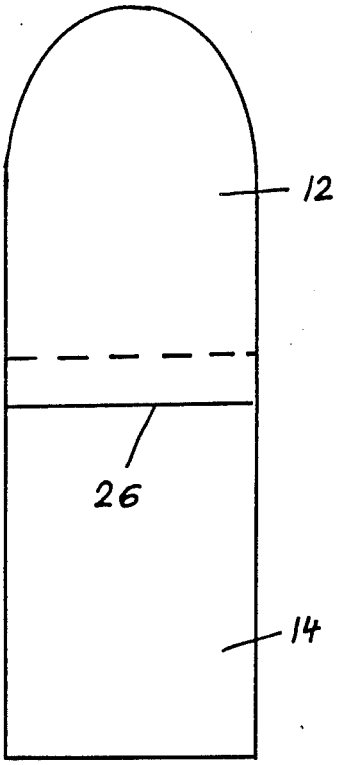
FIG. 2B is a picture of the bottom side of the middle section of my invention, showing the opening through which the stuffing can be inserted.
Figure 2C:
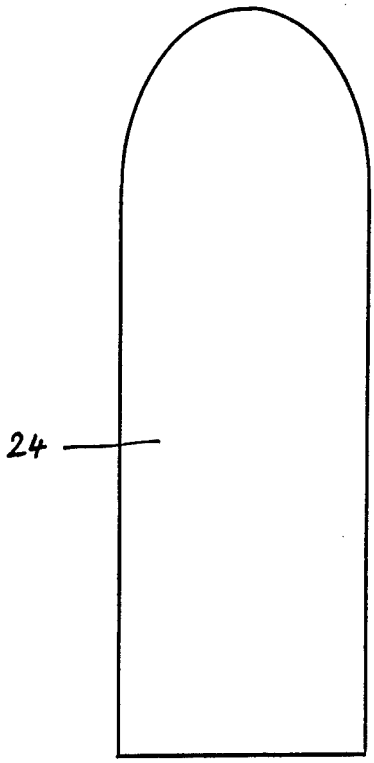
FIG. 2C is a picture of the stuffing cut our from batting.

A typical cover-up for infants is illustrated in the drawings. It consists of an elongated cloth middle section to which two smaller cloth side flaps are attached, a detachable waterproof or stain resistant pad, and removable piece of batting for stuffing the middle section. To accommodate the insertion or removal of the batting, the middle section is sewn together from three pieces of the cloth. Each of the two bottom pieces 12 and 14 (FIG. 2B) is about 8 cm longer than one half of the top piece 10 (FIG. 2A), which is approximately 120 cm (about 48') long and 40 cm (about 16') wide. One end of the bottom piece 12 and the top piece 10 is shown cut into a rounded shape. The side flaps 16 (FIG. 2A)

are made of single thickness of the cloth, and are about 30 cm 35 cm large. The waterproof pad is sewn together from two 35 cm×35 cm (about 16'×16') square pieces of material; the top one is of the same cloth as the cover-up (or from a suitable stain resistant fabric), and the bottom one is from vinyl or a similar waterproof material.

The pieces of the cover-up are joined together in a following manner: top edge (rounded or not) and side edges of piece 12, and one shorter and two longer side edges of piece 14 are matched with the corresponding edges of piece 10 (the pieces 12 and 14 overlap); the pieces 10, 12 and 14 are then sewn together along all outer edges of piece 10. This would make a bag with an opening 26 in the middle of the bottom side, formed by pieces 12 and 14 overlapping each othger. Through this oopening, the middle section of the cover-up can be stuffed with batting 24 (FIG. 2C) of the same size and shape as piece 10. The longer left edge of one flap 16 and the longer right edge of the other flap 16 are sewn to the long side edges of the middle section of the cover-up. The seems begin at about 55 cm from the bottom corners of the long middle section and end at about 90 cm from them.

On the cover-up illustrated by the drawings, the flaps' bottom and top hems 20 are threaded through by ties 22 made secure by sewing them into the seem when joining the flaps 16 to the middle section 10 of the cover-up. In the same way two more ties are threaded through a channel 20 made on the wrong side of each flap by a seem binding sewn to the flap in its middle.

One skilled in the art will realize that if the pieces 12 and 14 are previously finished at the opening 26 end, and the flaps are previously hemmed and provided with the channel 20 for the middle tie (as well as the ties themselves), all the above described joining of the pieces 10, 12 and 14, and the flaps 16 can be done by sewing one seem only. The ensuing bag can be then pulled through the back opening, turned to the right side of the fabric with the flaps and ties already attached and no further finishing of the seem edges necessary.

The optional waterproof 18 pad is attached to the piece 10 by several strips of hook and loop fastener, such as the ones sold under the trademark of Velcro located in the positions optimal for preventing the main body of the cover-up from becoming wet (or stained) in case that the baby's diaper leaks.

Figure 3:
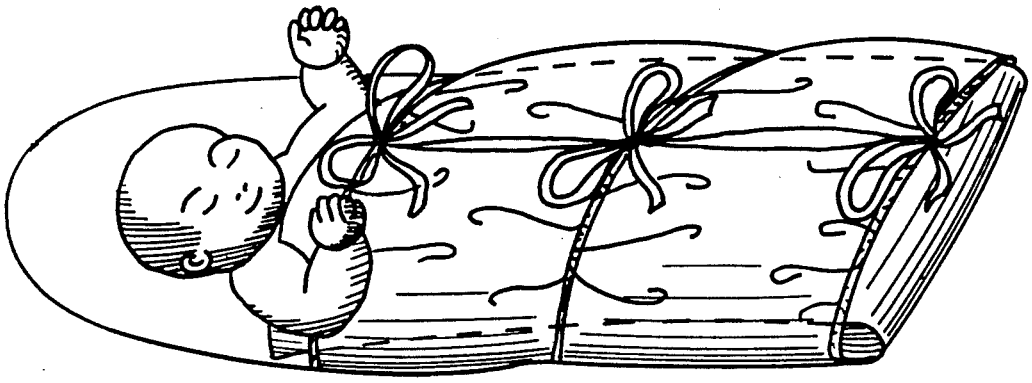
FIG. 3 is the perspective over-all view of the cover-up, showing it closed, with the baby inside. Reference Numerals in Drawings

FIG. 3 shows how the cover-up operates. The infant is placed on the middle section of the cover-up (made by above described joining of pieces 10, 12 and 14 and filled with batting 24), with his/her head towards the upper end. The lower end of this middle section is then folded along an imaginary fold-line (about where the lower corners of flaps 16 join the middle section 10) covering the body of the infant as much as wanted. This folded-over portion is then kept in its place by tying the side flaps 16 together over it. The ties can be tightened or loosened according to the age or size of the baby, securing the folded-over portion of the middle section of the cover-up from becoming unstuck, and at the same time providing in this way for a free movement of the baby's limbs and body.

That the system truly works has been repeatedly proven in the case of my own grandchild, and again six, four and two months ago with other babies whose mothers were given the cover-up for a trial period.

CONCLUSION

From the above description the reader will see that the present invention is a more functional as well as a healthier alternative for and improvement over the blankets used in the prior art, because it:

(a) provides better care of an infant by keeping him/her warmly wrapped without restricting his/her natural desire to move, (b) is therefore healthier than the receiving blanket used in the prior art, (c) provides for a better handling of the very young baby during his/her wakeful periods, (d) protects the baby against contracting cold or cold related illnesses should it become uncovered when not supervised, and (e) effectively liberates the person taking care of the baby from the worry that this could happen and thus insures her/his needed night rest.

While there are innovative features explained in the above description, the invention can be further considerably enhanced by other means, like employing assorted materials and by variations of the described design. The colorful flannels may be the obvious but not necessarily the only choice. Fleece, furs, or other warm materials can be used in colder climates, while lighter cotton or similar cloth may serve better in the warmer temperatures. Optionally a more delicate or finer cloth (like eyelet batiste or lace) can be used to construct the cover-up, which can then serve for a more formal occasions (baptism, christening, formal visiting etc.). Using the removable waterproof pad is, of course, also optional, and so is the use of the stuffing in itself, as well as the choice of the material with which the cover-up is filled. Polyester batting may be substituted for cotton batting (used in the above example of a typical cover-up), or some loose fill (cotton, polyester, fur, down/-small feathers and other suitable materials) can be used for filling the middle section of the cover-up, which could then be box-stitched or quilted.

The head-end of the middle section of the cover-up could be cut in diverse shapes, and decorated with optional ornamental lace border, or braid, or a ribbon, etc. in various designs. To suit the growing baby, the side flaps of the cover-up should be expandable, but this could be achieved by other means (for example elastic) than the picture ties (FIG. 3). The closing, too, could be conceived differently without presenting a danger to the baby hook and loop fastener, such as the one sold under the trademark of Velcro for example, or sewn-on snaps, rather than buttons). Other solution could be a design with the side flaps only wide enough to cover the gap formed on both sides of the cover-up by folding its lower part over the baby's body. They can be then held together by elastic straps clipped on to one (if sewn to the other) or both flaps at several places. Contrary to this, and to make the cover-up yet warmer (possibly for using it outside) the side flaps can be made wider, overlapping each other, and can be also filled with stuffing.

Another approach to making the cover-up will be cutting the middle section and the side flaps from the wraping material in one cross-shaped piece. This method would be time saving in case of factory manufacture, and would be especially suitable for double sided quilted materials.

Thus the scope of the invention should be determined by the appended claims and their legal equivalents, rather than by the example given.

I claim:

1. An infant supporting article comprising:

a) An oblong piece of wrapping material, the dimension of said piece of material being from approximately 100 cm×30 cm to about 150 cm×45 cm, fastening means, attached to both longer sides of said piece of wrapping material, approximately within the middle third of the total length of said piece of material, said fastening means comprising two supplemental rectangles, approximately 30 cm×35 cm large, of said wrapping material, each said rectangle having one longer edge sewn to one longer edge of said oblong piece of wrapping material, and remaining free longer edges of said rectangles are provided with means for attaching said rectangles together along said edges, the joint width of said rectangles being about one third bigger than the width of said piece of wrapping material, each one of said rectangles being gathered in the middle and along both shorter edges of said rectangles by lengths of expandable ties, said ties being means for attaching one of said rectangles to the other, and a waterproof pad attached to said piece of wrapping material by means allowing easy removal of said pad, whereby the infant is laid with his/her head towards one narrower end of said piece of material, the free unused portion of said piece of said material being loosely folded over the body of the lying infant and secured in place with said fastening means, thus keeping the infant's body securely covered-up and warm, while allowing for unrestricted movements of the infant's limbs and body.

2. The article of claim 1 wherein said wrapping material is a cloth.

3. The article of claim 1 wherein said wrapping material is natural or man-made fur.

4. The article of claim 1 wherein said piece of wrapping material is a flat bag with a cavity of said bag being filled with stuffing.

5. The article of claim 4 wherein said stuffing is cotton or polyester batting.

6. The article of claim 4 wherein said stuffing is goose down, and said bag is quilted.

7. The article of claim 1 wherein said rectangles and said oblong piece are cut from said wrapping material in one cross-shaped piece.

* * * * *